US011554944B2

(12) United States Patent
Hisada

(10) Patent No.: US 11,554,944 B2
(45) Date of Patent: Jan. 17, 2023

(54) FORK LIFT DEVICE

(71) Applicant: TOYOTA JIDOSHA KABUSHIKI KAISHA, Toyota (JP)

(72) Inventor: Kohei Hisada, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 249 days.

(21) Appl. No.: 16/827,744

(22) Filed: Mar. 24, 2020

(65) Prior Publication Data

US 2020/0354206 A1 Nov. 12, 2020

(30) Foreign Application Priority Data

May 7, 2019 (JP) ..... JP2019-087462

(51) Int. Cl.

| | |
|---|---|
| ***B66F 9/08*** | (2006.01) |
| ***B66F 9/12*** | (2006.01) |
| ***B66F 9/14*** | (2006.01) |
| ***B66F 9/075*** | (2006.01) |

(52) U.S. Cl.

CPC ..... *B66F 9/085* (2013.01); *B66F 9/122* (2013.01); *B66F 9/143* (2013.01); *B66F 9/145* (2013.01); *B66F 9/146* (2013.01); *B66F 9/0755* (2013.01)

(58) Field of Classification Search

CPC .... B66F 9/07; B66F 9/142; B66F 9/10; B66F 9/146; B66F 9/143; B66F 9/122; B66F 9/085; B65G 1/0435; B65G 1/0492; B65G 1/0407

See application file for complete search history.

(56) References Cited

U.S. PATENT DOCUMENTS

2021/0309457 A1* 10/2021 Tsuji ..... B65G 1/0407

FOREIGN PATENT DOCUMENTS

| | | | | |
|---|---|---|---|---|
| CN | 108773798 | A | 11/2018 | |
| CN | 111776568 | A * | 10/2020 | |
| DE | 195 19 643 | A1 | 12/1996 | |
| DE | 10127949 | A1 * | 12/2002 | ..... B66F 9/08 |
| DE | 10 2016 216 574 | B3 | 7/2017 | |
| EP | 1512661 | A1 * | 3/2005 | ..... B65G 1/0407 |
| EP | 2487067 | A2 * | 8/2012 | ..... B60P 1/4414 |
| EP | 3885306 | A1 * | 9/2021 | |
| JP | 7-237900 | A | 9/1995 | |
| JP | 2008-519742 | A | 6/2008 | |
| KR | 10-2013-0062132 | | 6/2013 | |
| KR | 10-2013-0112659 | | 10/2013 | |

* cited by examiner

*Primary Examiner* — Kaitlin S Joerger
(74) *Attorney, Agent, or Firm* — Oblon, McClelland, Maier & Neustadt, L.L.P.

(57) ABSTRACT

To realize a fork lift device capable of contributing to space-saving for an aisle width at a warehouse. A fork lift device according to an embodiment of the present includes: a first fork and a second fork moveable in a lateral direction and a vertical direction with respect to a traveling direction; and an interchanging mechanism configured to interchange vertical positions of the first fork and the second fork.

6 Claims, 14 Drawing Sheets

FORK LIFT DEVICE

CROSS REFERENCE TO RELATED APPLICATIONS

This application is based upon and claims the benefit of priority from Japanese patent application No. 2019-087462, filed on May 7, 2019, the disclosure of which is incorporated herein in its entirety by reference.

BACKGROUND

The present disclosure relates to a fork lift device, for example, a fork lift device including first and second forks that are moveable laterally and vertically with respect to the traveling direction of the fork lift.

A general fork lift device is configured so that when objects to be conveyed are stacked in a multi-tier state and one of them is to be pulled out from a lower tier, it can pull out that object to be conveyed by using a plurality of forks. For example, a two-tier type fork lift device disclosed in Japanese Unexamined Patent Application Publication No. H7-237900 has a configuration in which an upper fork and a lower fork are provided integrally with a mast that is expandable/contractible in a vertical direction such that the upper fork and the lower fork are moveable laterally and rotatable about a rotary shaft extending vertically. In this fork lift device, only the upper fork is provided on the mast in a vertically moveable manner.

In this kind of two-tier type fork lift device, when an object to be conveyed (hereinafter also referred to as a conveyance object) is pulled out from a lower tier in a multi-tier state, the upper fork and the lower fork are rotated about the rotary shaft so as to extend laterally. Then, first, the upper fork is moved laterally in either the rightward or the leftward direction so as to support a conveyance object in an upper tier with respect to the conveyance object in the lower tier, and then, the lower fork is moved laterally in the same direction (i.e., either the rightward or the leftward direction) so as to support the conveyance object in the lower tier. Then, by moving the lower fork laterally in the opposite direction (i.e. either in the rightward or the leftward direction) while supporting the conveyance object in the lower tier, the conveyance object in the lower tier is pulled out.

SUMMARY

The applicant of the present disclosure has found the following problem. In the two-tier type fork lift device disclosed in Japanese Unexamined Patent Application Publication No. H7-237900, when the upper fork is lowered so as to place the conveyance object supported by the upper fork on the floor after the conveyance object in the lower tier is pulled out, the lower fork is positioned on the side laterally opposite to the side on which the upper fork is positioned.

Since only the upper fork is disposed integrally with the mast in the vertically moveable manner in the two-tier type fork lift device disclosed in Japanese Unexamined Patent Application Publication No. H7-237900, when the upper fork is withdrawn from a pallet on which the conveyance object is placed in the above-described state, the lower fork cannot be receded therefrom, and thus the two-tier type fork lift device itself needs to be moved to the side laterally opposite to the side on which the upper fork is positioned. Consequently, it becomes necessary to secure, in an aisle in a warehouse where conveyance objects are stored, a space where the two-tier type fork lift device can be moved to the side laterally opposite to the side on which the upper fork is positioned when pulling out a conveyance object from a lower tier in a multi-tier state.

The present disclosure has been made in view of the aforementioned problem and provides a fork lift device that contributes to space-saving in regard to the width of an aisle in a warehouse.

An exemplary aspect according to the present disclosure is a fork lift device including:

a first fork and a second fork moveable in a lateral direction and a vertical direction with respect to a traveling direction; and an interchanging mechanism configured to interchange vertical positions of the first fork and the second fork.

By this configuration, there is no need to laterally move the fork lift device when the first fork and the second fork are withdrawn from the conveyance object and thus, it is possible to contribute to space-saving in regard to the width of an aisle in a warehouse where the conveyance object is stored.

In the aforementioned fork lift device, the interchanging mechanism may include:

a first mast;

a second mast disposed at an interval from the first mast in the traveling direction;

a first moving mechanism provided on the second mast side of the first mast in a moveable manner in the vertical direction and configured to move the first fork in the lateral direction; and a second moving mechanism provided on the first mast side of the second mast in a moveable manner in the vertical direction and configured to move the second fork in the lateral direction, in which positions of the first fork and the second fork in the vertical direction are interchanged by moving the first fork or the second fork in the lateral direction.

By this configuration, it is possible to restrain the fork lift device from becoming large lengthwise in a longitudinal direction thereof.

In the aforementioned fork lift device, the length of one of the first moving mechanism and the second moving mechanism in the lateral direction may be shorter than the length of the other moving mechanism in the lateral direction.

By this configuration, it is possible to reduce the weight of the fork lift device as well as the cost of the components thereof.

In the aforementioned fork lift device, the interchanging mechanism may include a third moving mechanism configured to move one of the first fork and the second fork in the traveling direction or in the direction opposite to the traveling direction.

By this configuration, the first fork and the second fork can be readily disposed at positions that are shifted from each other in the longitudinal direction.

In the aforementioned fork lift device, the interchanging mechanism may include an interval changing mechanism configured to change an interval between claw parts of the first fork or the second fork.

By this configuration, even when the sizes differ among the conveyance objects, it is possible to convey the conveyance objects satisfactorily, and the versatility of the fork lift device can be enhanced.

In the aforementioned fork lift device, the interchanging mechanism may include a rotating mechanism configured to rotate the first fork or the second fork about the rotary shaft extending vertically.

By this configuration, the conveyance object can be pulled out satisfactorily even when the conveyance object to be pulled out is disposed in a rotated state relative to a conveyance object in another tier.

The aforementioned fork lift device includes:

a first fork lift in which the first mast is supported by a first carriage; and a second fork lift in which the second mast is supported by a second carriage, and the first and second fork lifts may be synchronously controlled to make them perform identical tasks.

By this configuration, the first fork lift and the second fork lift can be moved independently of each other besides the case where a conveyance object is pulled out from a lower tier in a multi-tier state.

According to the present disclosure, it is possible to realize a fork lift device that can contribute to space-saving in regard to the width of an aisle in a warehouse.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Specific embodiments to which the present disclosure is applied will be described hereinafter in detail with reference to the drawings. However, the present disclosure is not limited to the embodiments shown below. Further, the following descriptions and drawings are simplified as appropriate for clarifying the explanation.

First Embodiment

Figure 1:
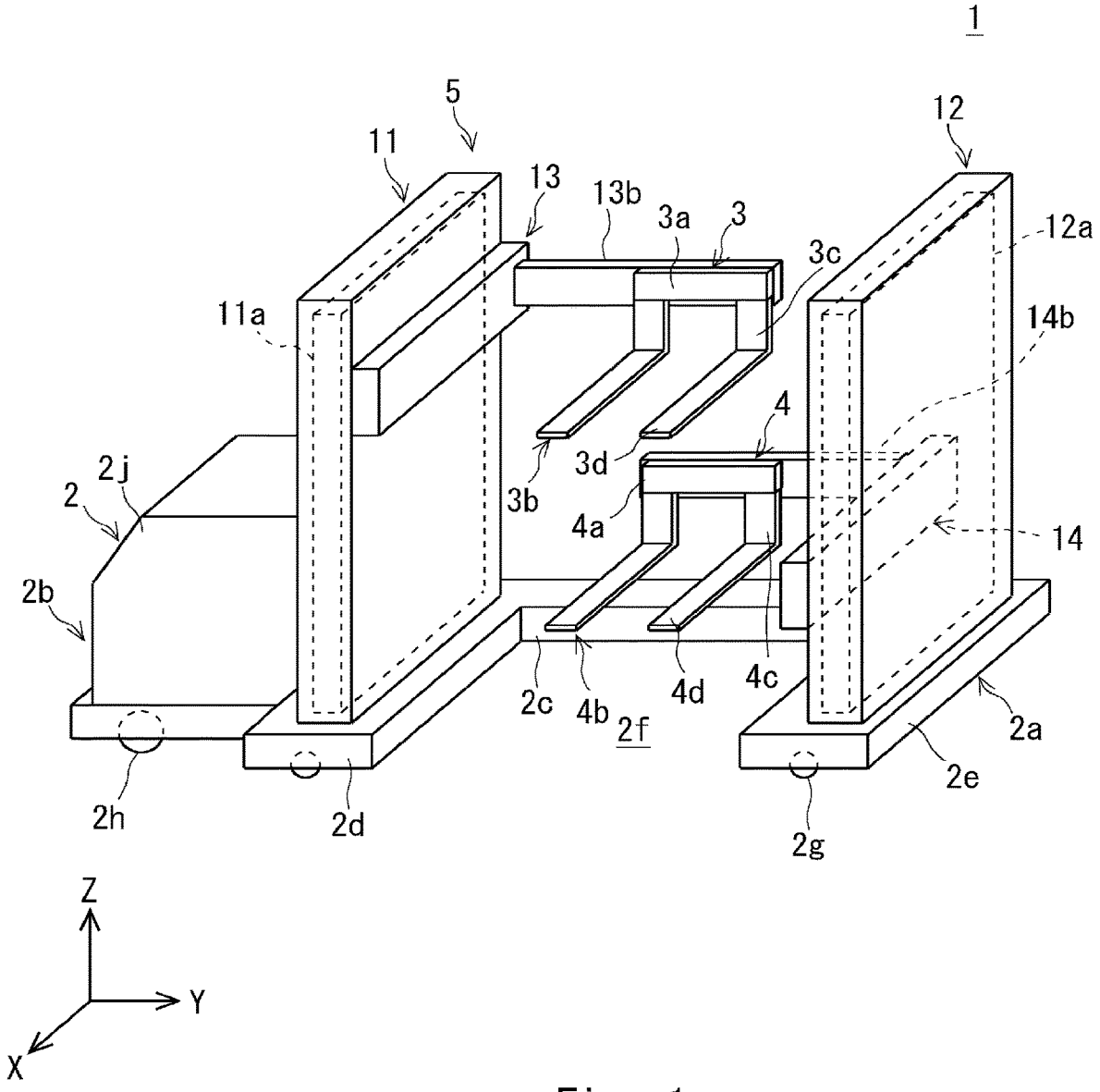
FIG. 1 is a perspective view schematically showing a fork lift device according to a first embodiment.
Figure 2:
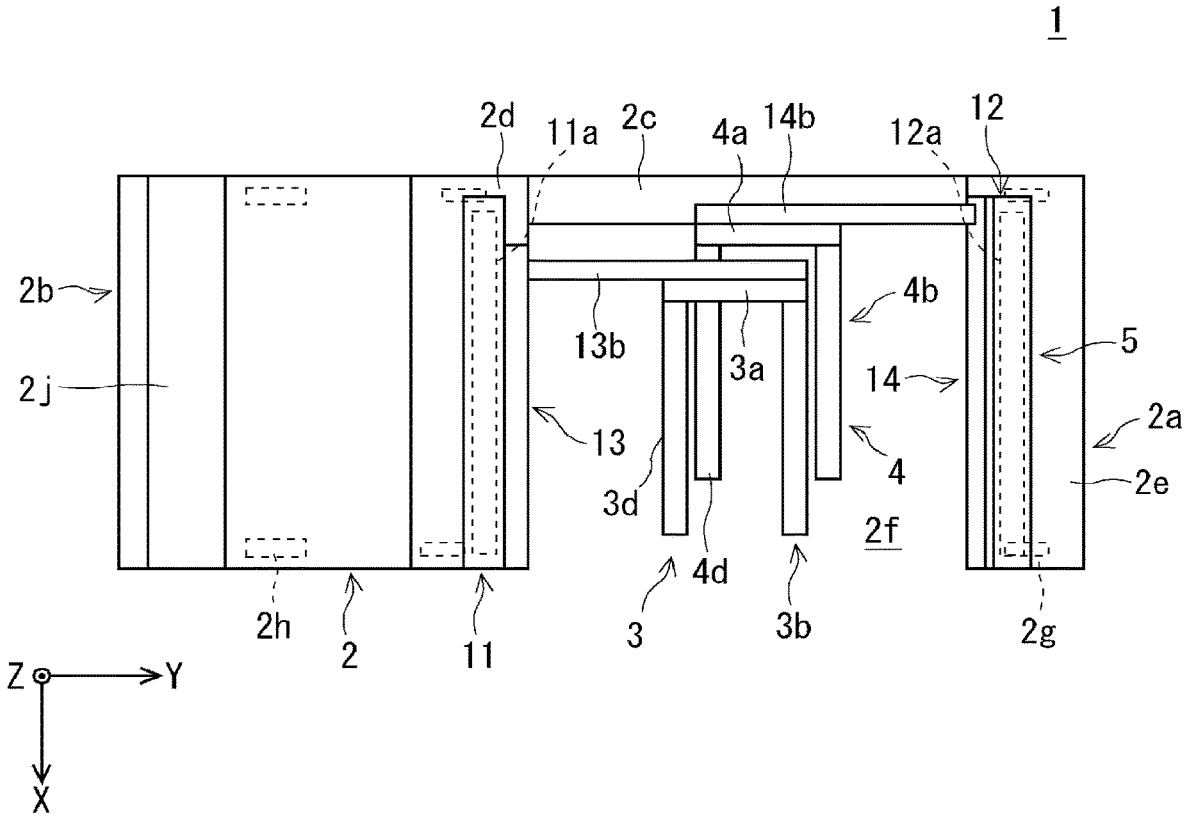
FIG. 2 is a plan view schematically showing the fork lift device according to the first embodiment.
Figure 3:
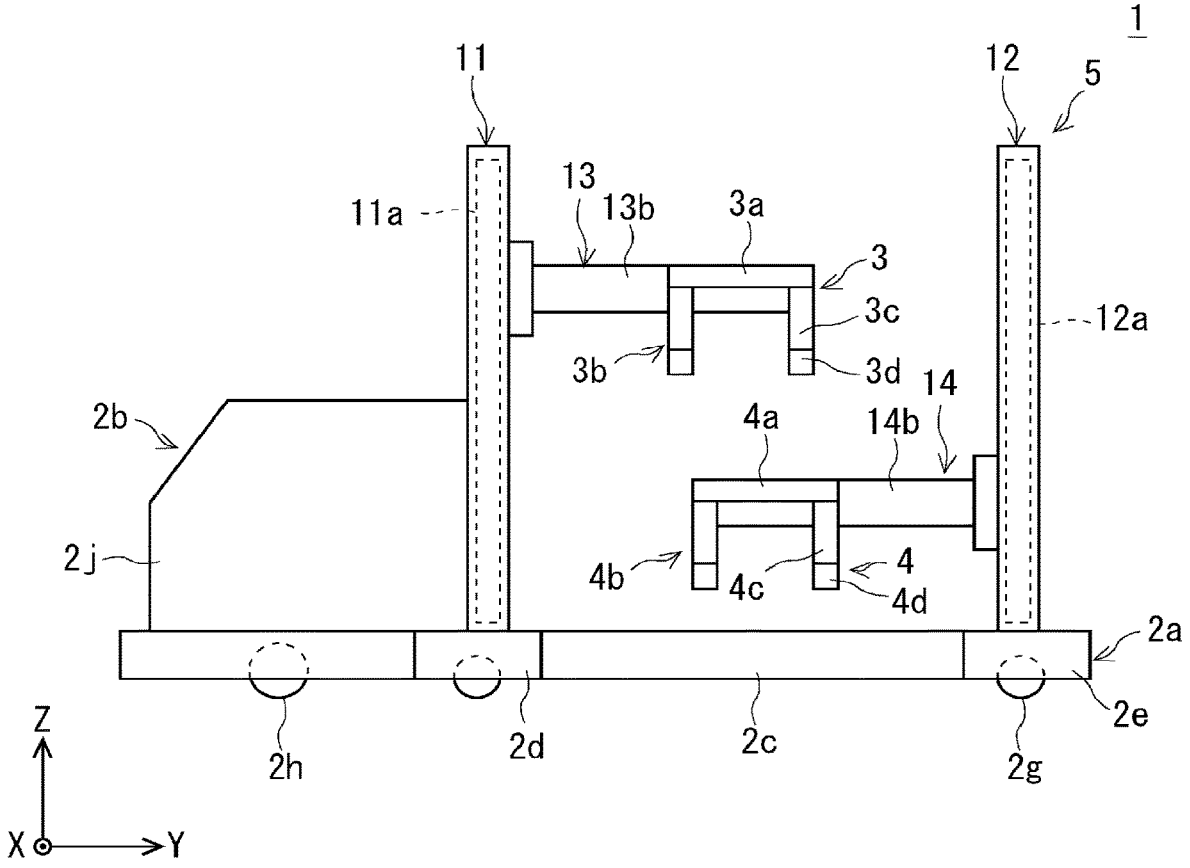
FIG. 3 is a side view schematically showing the fork lift device according to the first embodiment.
Figure 4:
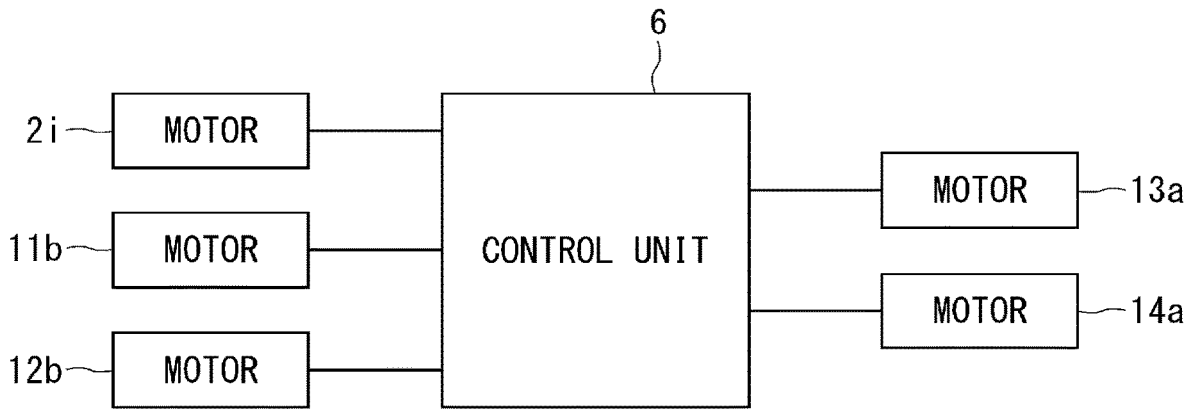
FIG. 4 is a block diagram showing a control system of the fork lift device according to the first embodiment.

First, a fork lift device according to this embodiment is explained. FIG. 1 is a perspective view schematically showing the fork lift device according to this embodiment. FIG. 2 is a plan view schematically showing the fork lift device according to this embodiment. FIG. 3 is a side view schematically showing the fork lift device according to this embodiment. FIG. 4 is a block diagram showing a control system of the fork lift device according to this embodiment. Note that in FIGS. 1 to 3, the configuration of the fork lift device is shown in a simplified manner.

In order to clarify the explanation given below, a three-dimensional (XYZ) coordinate system is used. The Y-axis positive side is the traveling direction side of the fork lift device, the X-axis positive side is the right-hand side of the fork lift device, the X-axis negative side is the left-hand side of the fork lift device, the Z-axis positive side is the upper side of the fork lift device, and the Z-axis negative side is the lower side of the fork lift device.

The fork lift device 1 according to this embodiment includes, as shown in FIGS. 1 to 4, a carriage 2, a first fork 3, a second fork 4, an interchanging mechanism 5, and a control unit 6, and is configured such that the positions of the first fork 3 and the second fork 4 in the Z-axis direction can be interchanged.

The carriage 2 includes a frame part 2*a* and a driving part 2*b*. The frame part 2*a* has, for example, a U-shape when viewed in the Z-axis direction and includes a first part 2*c* extending in the Y-axis direction, a second part 2*d* protruding from an end of the first part 2*c* on the Y-axis negative side to the X-axis positive side, and a third part 2*e* protruding from an end of the first part 2*c* on the Y-axis positive side to the X-axis positive side.

Further, a space 2*f* formed by the first part 2*c*, the second part 2*d*, and the third part 2*e* when viewed in the Z-axis direction has enough room to place the conveyance object therein. A plurality of adjustable casters 2*g* are provided to a surface of the frame part 2*a* on the Z-axis negative side.

The driving part 2*b* includes, for example, a wheel 2*h* provided in a rotatable manner to a bottom part that protrudes from the frame part 2*a* to the Y-axis negative side. The wheel 2*h* is rotated by rotational driving power transmitted from a motor 2*i*. The traveling and the rotating of the fork lift device 1 in the Y-axis direction is realized when the wheel 2*h* is rotated by the driving power transmitted from the motor 2*i*. The wheel 2*h* and the motor 2*i* are covered with a cover 2*j*. However, the driving part 2*b* may be structured in any way as long as it is capable of letting the fork lift device 1 travel.

The first fork 3 has a shape which enables the conveyance object to be supported. The first fork 3 includes, for example, a base part 3*a* and claw parts 3*b*. The base part 3*a* has a plate-like shape the length of which in the Y-axis direction is longer than the height thereof in the Z-axis direction. The claw parts 3*b* are provided in the base part 3*a* with an interval therebetween in the Y-axis direction, and protrude from the base part 3*a* to the X-axis positive side.

To be more specific, each of the claw parts 3*b* has a substantially L-shape when viewed in the Y-axis direction and includes a first part 3*c* extending in the Z-axis direction and a second part 3*d* protruding from an end of the first part 3*c* on the Z-axis negative side to the X-axis positive side. Further, an end of the first part 3*c* on the Z-axis positive side is fixed to the base part 3*a*. By this configuration, the claw parts 3*b* are provided so as to hang down from the base part 3*a*. The second parts 3*d* of this kind of claw parts 3*b* are inserted into, for example, a fork insertion hole of the pallet for a conveyance object when the fork lift device pulls out the conveyance object.

The second fork 4 includes a base part 4*a* and claw parts 4*b*, and since the configuration of the second fork 4 is the same as that of the first fork 3, duplicate explanation thereof is omitted. Further, each of the claw parts 4*b* includes a first part 4*c* extending in the Z-axis direction and a second part 4*d* protruding from an end of the first part 4*c* on the Z-axis negative side to the X-axis positive side, and an end of the second part 4*d* on the Z-axis positive side is fixed to the base part 4*a*.

The interchanging mechanism 5 interchanges the positions of the first fork 3 and the second fork 4 in the Z-axis direction. Here, the interchanging mechanism 5 of this embodiment is configured such that the positions of the first fork 3 and the second fork 4 in the Z-axis direction can be interchanged by moving the forks in the X-axis direction, the detailed movement of which will be described later. The interchanging mechanism 5 includes, for example, a first mast 11, a second mast 12, a first moving mechanism 13, and a second moving mechanism 14.

The first mast 11 protrudes from the second part 2*d* of the frame part 2*a* to the Z-axis positive side and includes an ascending/descending mechanism 11*a* that moves the first moving mechanism 13 in the Z-axis direction. As the ascending/descending mechanism 11*a*, an ascending/descending mechanism used in a general fork lift device can be used. For example, a slider provided in a moveable manner in the Z-axis direction with respect to the first mast 11 is ascended/descended by driving a motor 11*b*, and the first moving mechanism 13 is fixed to the Y-axis positive side of the slider.

The second mast 12 protrudes from the third part 2*e* of the frame part 2*a* to the Z-axis positive side and includes an ascending/descending mechanism 12*a* that moves the second moving mechanism 14 in the Z-axis direction. The ascending/descending mechanism 12*a* has substantially the same configuration as that of the ascending/descending mechanism 11*a*. That is, the ascending/descending mechanism 12*a* is configured such that a slider provided on the second mast 12 in a moveable manner in the Z-axis direction is ascended/descended by driving a motor 12*b*, and the second moving mechanism 14 is fixed to the Y-axis negative side of the slider. The interval between the first mast 11 and the second mast 12 described above in the Y-axis direction is wider than at least the width of the conveyance object.

The first moving mechanism 13 is configured such that the first fork 3 can be moved in the X-axis direction. To be more specific, as the first moving mechanism 13, a horizontal moving mechanism used in a general fork lift device can be used. For example, a slider moves on a rail that is fixed to the ascending/descending mechanism 11*a* of the first mast 11 and that extends in the X-axis direction by driving a motor 13*a*.

This kind of slider includes an arm part 13*b* that protrudes from the slider to the Y-axis positive side. Further, an end of the arm part 13*b* on the Y-axis positive side is fixed to the base part 3*a* of the first fork 3. Accordingly, a configuration in which the first fork 3 is moveable in the X-axis direction and the Z-axis direction is realized.

The second moving mechanism 14 is configured such that the second fork 4 can be moved in the X-axis direction. To be more specific, the second moving mechanism 14 has substantially the same configuration as that of the first moving mechanism 13. For example, a slider moves on a rail that is fixed to the ascending/descending mechanism 12*a* of the second mast 12 and that extends in the X-axis direction by driving a motor 14*a*.

This kind of slider has an arm part 14*b* that protrudes from the slider to the Y-axis negative side. Further, an end of the arm part 14*b* on the Y-axis negative side is fixed to the base part 4*a* of the second fork 4. Accordingly, a configuration in which the second fork 4 is moveable in the X-axis direction and the Z-axis direction is realized.

At this time, the second parts 3*d* of the claw parts 3*b* of the first fork 3 protrude from the end of the fork lift device 1 on the X-axis positive side in a state in which the first fork 3 is disposed on the farthest side of the X-axis positive side, and further, the second parts 4*d* of the claw parts 4*b* of the second fork 4 protrude from the end of the fork lift device 1 on the X-axis positive side in a state in which the second fork 4 is disposed on the farthest side of the X-axis positive side.

Further, the first moving mechanism 13 and the second moving mechanism 14 have a moveable range in the X-axis direction within which the first fork 3 and the second fork 4 can be aligned in the X-axis direction in a state in which the first fork 3 or the second fork 4 is disposed on the farthest side of the X-axis positive side.

Here, the first fork 3 and the second fork 4 may be disposed at positions that are shifted from each other in the Y-axis direction so as to be disposed at the same height in the Z-axis direction without having them interfering with each other, the detailed function of which will be described later. At this time, the length of the second parts 3*d* and 4*d* in the Y-axis direction may be shorter than the width of the fork insertion holes of the respective pallets so that the second parts 3*d* of the claw parts 3*b* of the first fork 3 and the second parts 4*d* of the claw parts 4*b* of the second fork 4 that are shifted from each other in the Y-axis direction can be inserted into the fork insertion holes of the respective pallets on which the conveyance objects are placed in a multi-tier state.

The control unit 6 controls the motor 2*i* of the driving part 2*b*, the motor 11*b* of the ascending/descending mechanism 11*a*, the motor 12*b* of the ascending/descending mechanism 12*a*, the motor 13*a* of the first moving mechanism 13, and the motor 14*a* of the second moving mechanism 14, the details of which will be described later.

Next, a flow of how a desired conveyance object is pulled out is explained with reference to the fork lift device 1 according to this embodiment. FIGS. 5A to 5G are diagrams for explaining the flow of how a desired conveyance object is pulled out using the fork lift device according to this embodiment. Note that in FIGS. 5A to 5G, the XZ space where the fork lift device according to this embodiment moves when pulling out a desired conveyance object is shown by the broken lines.

Note that in FIGS. 5A to 5G, the first fork 3 and the second fork 4 are extracted from the fork lift device 1 in order to clarify how the first fork 3 and the second fork 4 are interchanged.

Here, the conveyance object 7 is constituted of a pallet loaded with components etc., although the details of which are not shown in the figures. In the explanation given below, of the conveyance object 7 which is in a multi-tier state of 4 tiers, the conveyance object 7*a* which is in the lowest tier is pulled out. The pallet is a general pallet and its width dimension in the X-axis direction is 1000 mm and its width dimension in the Y-axis direction is 1400 mm. The size of the pallet is not limited.

Here, it is assumed that as an operator inputs a task command for pulling out the conveyance object 7*a* through an input unit (not shown), the fork lift device 1 autonomously performs a task of pulling out the conveyance object 7*a*. However, the task of pulling out the conveyance object 7*a* may also be realized by having the operator operate the fork lift device through an operation unit.

Figure 5A:
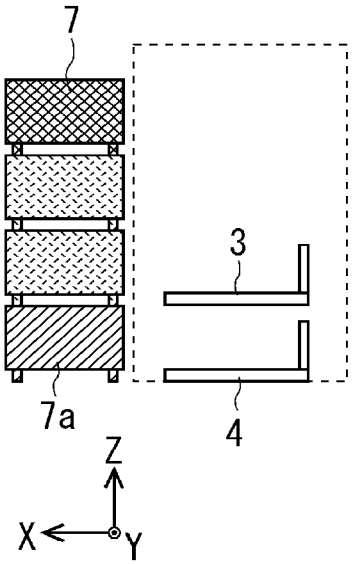
FIG. 5A is a diagram for explaining a flow of how a desired conveyance object is pulled out using the fork lift device according to the first embodiment.

First, when the operator inputs positional information etc. of the conveyance object 7*a* through the input unit, the control unit 6 controls the motor 2*i* of the driving part 2*b* and lets the fork lift device 1 travel so that the fork lift device 1 is disposed on the X-axis negative side with respect to the conveyance object 7*a* as shown in FIG. 5A.

Figure 5B:
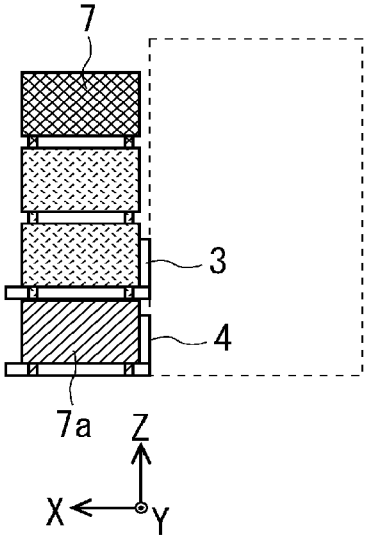
FIG. 5B is a diagram for explaining a flow of how a desired conveyance object is pulled out using the fork lift device according to the first embodiment.

Next, the control unit 6 controls the motor 11*b* of the ascending/descending mechanism 11*a*, the motor 12*b* of the ascending/descending mechanism 12*a*, the motor 13*a* of the first moving mechanism 13, and the motor 14*a* of the second moving mechanism 14, and as shown in FIG. 5B, thereby inserts the second parts 3*d* of the claw parts 3*b* of the first fork 3 into the fork insertion hole of the pallet for a conveyance object 7 located one tier above the conveyance object 7*a* on the Z-axis positive side and inserts the second parts 4*d* of the claw parts 4*b* of the second fork 4 into the fork insertion hole of the pallet for the conveyance object 7*a*.

At this time, when the length of the respective second parts 3*d* and 4*d* in the Y-axis direction is shorter than the width of the fork insertion holes of the respective pallets in the Y-axis direction so that the second parts 3*d* of the claw parts 3*b* of the first fork 3 and the second parts 4*d* of the claw parts 4*b* of the second fork 4 that are shifted from each other in the Y-axis direction can be inserted into the fork insertion holes of the respective pallets on which the conveyance objects 7*a* and 7 are placed in a stacked state, the second parts 3*d* and 4*d* can be inserted satisfactorily in the fork insertion holes of the respective pallets of the conveyance objects 7*a* and 7.

Figure 5C:
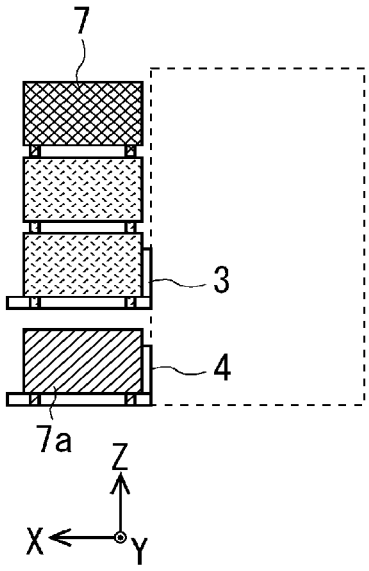
FIG. 5C is a diagram for explaining a flow of how a desired conveyance object is pulled out using the fork lift device according to the first embodiment.
Figure 5D:
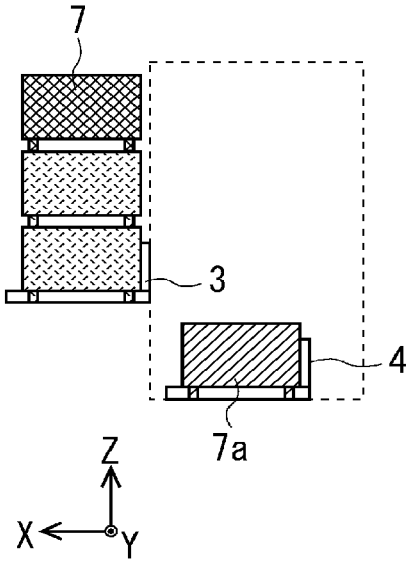
FIG. 5D is a diagram for explaining a flow of how a desired conveyance object is pulled out using the fork lift device according to the first embodiment.

Next, the control unit 6 controls the motor 11*b* of the ascending/descending mechanism 11*a* and moves the first fork 3 to the Z-axis positive side so as to support the conveyance object 7 disposed on the Z-axis positive side with respect to the conveyance object 7*a* as shown in FIG. 5C. Then, while supporting the conveyance object 7 by the first fork 3, the control unit 6 controls the motor 14*a* of the second moving mechanism 14 so as to move the second fork 4 to the X-axis negative side and pull out the conveyance object 7*a* to the space 2*f* of the frame part 2*a* as shown in FIG. 5D.

Figure 5E:
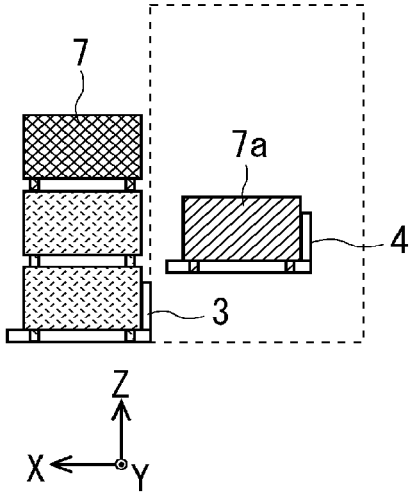
FIG. 5E is a diagram for explaining a flow of how a desired conveyance object is pulled out using the fork lift device according to the first embodiment.

Next, the control unit 6 controls the motor 11*b* of the ascending/descending mechanism 11*a* so as to move the first fork 3 to the Z-axis negative side and place the conveyance object 7 supported by the first fork 3 on the floor as shown in FIG. 5E. At this time, the first fork 3 and the second fork 4 can be aligned in the X-axis direction since the first moving mechanism 13 and the second moving mechanism 14 have a moveable range in the X-axis direction within which the first fork 3 and the second fork 4 can be aligned in the X-axis direction.

Figure 5F:
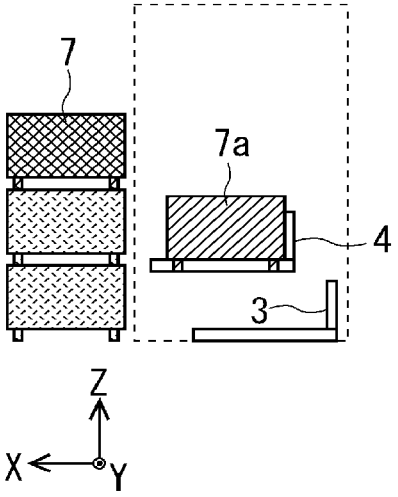
FIG. 5F is a diagram for explaining a flow of how a desired conveyance object is pulled out using the fork lift device according to the first embodiment.

Next, the control unit 6 controls the motor 12*b* of the ascending/descending mechanism 12*a* so as to move the second fork 4 that supports the conveyance object 7*a* to the Z-axis positive side and secure a space for the first fork 3 to enter on the Z-axis negative side of the second fork 4 as shown in FIG. 5E. Then, the control unit 6 controls the motor 13*a* of the first moving mechanism 13 so as to move the first fork 3 to the X-axis negative side and withdraws the second parts 3*d* of the claw parts 3*b* of the first fork 3 from the pallet on which the conveyance object 7 is placed as shown in FIG. 5F.

At this time, the second fork 4 is not disposed on the X-axis negative side with respect to the first fork 3 and a space for the first fork 3 to enter is secured. Therefore, the first fork 3 can be moved to the X-axis negative side, and there is no need to move the fork lift device 1 itself to the X-axis negative side when the second parts 3*d* of the claw parts 3*b* of the first fork 3 are withdrawn from the pallet on which the conveyance object 7 is placed.

Figure 5G:
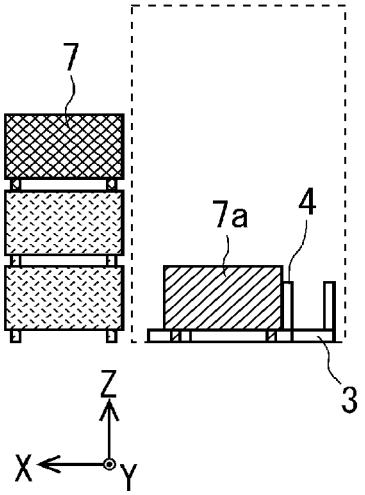
FIG. 5G is a diagram for explaining a flow of how a desired conveyance object is pulled out using the fork lift device according to the first embodiment.

Lastly, the control unit 6 controls the motor 12*b* of the ascending/descending mechanism 12*a* so as to move the second fork 4 to the Z-axis negative side and place the conveyance object 7*a* on the floor within the space 2*f* of the frame part 2*a* as shown in FIG. 5G and the task of pulling out the conveyance object 7*a* ends.

At this time, since the second parts 3*d* of the claw parts 3*b* of the first fork 3 and the second parts 4*d* of the claw parts 4*b* of the second fork 4 can be disposed so as to be shifted from each other in the X-axis direction and the Y-axis direction, the second fork 4 can place the conveyance object 7*a* on the floor without interfering with the first fork 3.

As described above, the fork lift device 1 according to this embodiment is configured such that the positions of the first fork 3 and the second fork 4 in the Z-axis direction can be interchanged. Accordingly, it is possible to secure a space for the first fork 3 to enter on the X-axis negative side when withdrawing the second parts 3*d* of the claw parts 3*b* of first fork 3 from the pallet on which the conveyance object 7 is placed.

Therefore, when the first fork 3 is moved to the X-axis negative side, the second parts 3*d* of the claw parts 3*b* of the first fork 3 can be withdrawn from the pallet on which the conveyance object 7 is placed. Thus, since there is no need to move the fork lift device 1 itself to the X-axis negative side when withdrawing the second parts 3*d* of the claw parts 3*b* of the first fork lift 3 from the pallet on which the conveyance object 7 is placed, it is possible to contribute to space-saving for an aisle width at a warehouse where the conveyance object 7 is stored. As a result, it is possible to enhance the storage efficiency of the conveyance object 7 at a warehouse.

Moreover, there is no need to structure the fork lift device 1 in such a peculiar manner that the fork lift device 1 does a translational motion in the Y-axis direction. That is, for example, the fork lift device 1 according to this embodiment can be formed by employing the first mast 11 including the first moving mechanism 13 and the first fork 3 and the second mast 12 including the second moving mechanism 14 and the second fork 4 in place of the masts of a general fork lift device.

Further, the fork lift device 1 according to this embodiment has a structure in which the positions of the first fork 3 and the second fork 4 in the Z-axis direction can be interchanged by moving the forks in the X-axis direction by utilizing the storage space for the conveyance object 7 and thus, it is possible to restrain the fork lift device 1 from becoming large lengthwise in the Y-axis direction.

Here, the first moving mechanism 13 may be short lengthwise in the X-axis direction with respect to the second moving mechanism 14 as shown in FIG. 2. This is because in order to dispose the first fork 3 and the second fork 4 at the same height in the Z-axis direction without them interfering with each other, it is necessary to dispose the first fork 3 and the second fork 4 at positions that are shifted from each other not only in the Y-axis direction but also in the X-axis direction, which can be realized when only the length of the second moving mechanism 14 in the X-axis direction is longer than the length of the first moving mechanism 13 in the X-axis direction. By this configuration, it is possible to realize a reduction in the weight of the fork lift device 1 as well as a decrease in the cost of the components of the fork lift device 1. However, the length of the first moving mechanism 13 in the X-axis direction may be made longer than the length of the second moving mechanism 14 in the X-axis direction.

Note that when the length of each of the second parts 3*d* of the claw parts 3*b* of the first fork 3 and the second parts 4*d* of the claw parts 4*b* of the second fork 4 is substantially the same as the size of the fork insertion hole of the respective pallets in the Y-axis direction, first, the second parts 3*d* of the claw parts 3*b* of the first fork 3 are inserted into the fork insertion hole of the pallet on which the conveyance object 7 is placed, and the conveyance object 7 is moved to the Z-axis positive side and supported by the first fork 3, then, the fork lift device 1 is moved in the Y-axis direction so as to insert the second parts 4*d* of the claw parts 4*b* of the second fork 4 into the fork insertion hole of the pallet on which the conveyance object 7*a* is placed.

Second Embodiment

Figure 6:
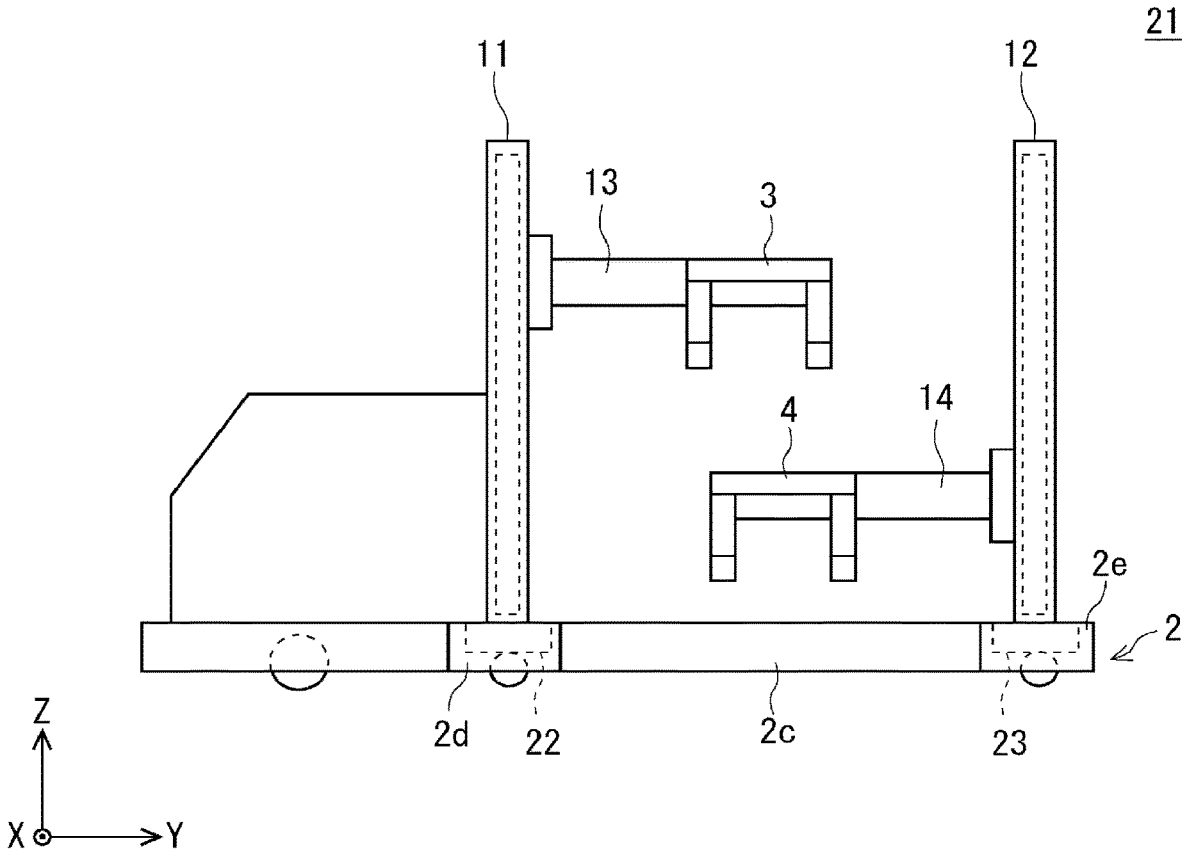
FIG. 6 is a side view schematically showing a fork lift device according to a second embodiment.

FIG. 6 is a side view schematically showing a fork lift device according to this embodiment. In FIG. 6, the configuration of the fork lift device is shown in a simplified manner. In the explanation given below, parts that are the same as those of the first embodiment are omitted and the corresponding members or the equivalent members are referred to by the same reference signs.

As shown in FIG. 6, a fork lift device 21 according to this embodiment has substantially the same configuration as that of the fork lift device 1 according to the first embodiment except that a third moving mechanism 22 that moves the first mast 11 in the Y-axis direction and a fourth moving mechanism 23 that moves the second mast 12 in the Y-axis direction are included.

The third moving mechanism 22 includes, for example, a hydraulic cylinder provided to the second part 2*d* of the frame part 2*a*, and is configured so as to move the first mast 11 in the Y-axis direction by expanding/contracting a rod of the third moving mechanism 22. The fourth moving mechanism 23 includes, for example, a hydraulic cylinder provided to the third part 2*e* of the frame part 2*a*, and is configured so as to move the second mast 12 in the Y-axis direction by expanding/contracting a rod of the fourth moving mechanism 23.

As described above, by employing a configuration in which the first mast 11 and the second mast 12 are movable in the Y-axis direction, it is possible to dispose the first fork 3 and the second fork 4 at positions that are shifted from each other in the Y-axis direction so as not to interfere with each other when, for example, the first fork 3 and the second fork 4 are disposed at substantially the same height in the Z-axis direction in order to place the conveyance object 7*a* on the floor.

However, the third moving mechanism 22 and the fourth moving mechanism 23 may be configured in any way as long as they can move the first mast 11 and the second mast 12 in the Y-axis direction. A linear actuator, for example, may be employed and the driving method thereof is not limited.

Further, in this embodiment, the moving mechanism is configured such that both of the first mast 11 and the second mast 12 are moveable in the Y-axis direction. However, it may be configured such that either the first mast 11 or the second mast 12 is moveable in the Y-axis direction.

Further, in this embodiment, the fork is moved in the Y-axis direction via the mast, however, the fork may be moved in the Y-axis direction without employing the mast. In this case, the moving mechanism in the Y-axis direction may be disposed between the arm part 13*b* of the first moving mechanism 13 and the base part 3*a* of the first fork 3 or between the arm part 14*b* of the second moving mechanism 14 and the base part 4*a* of the second fork 4. That is, the moving mechanism may have any configuration as long as it can move either the first fork 3 or the second fork 4 in the Y-axis direction.

Third Embodiment

Figure 7:
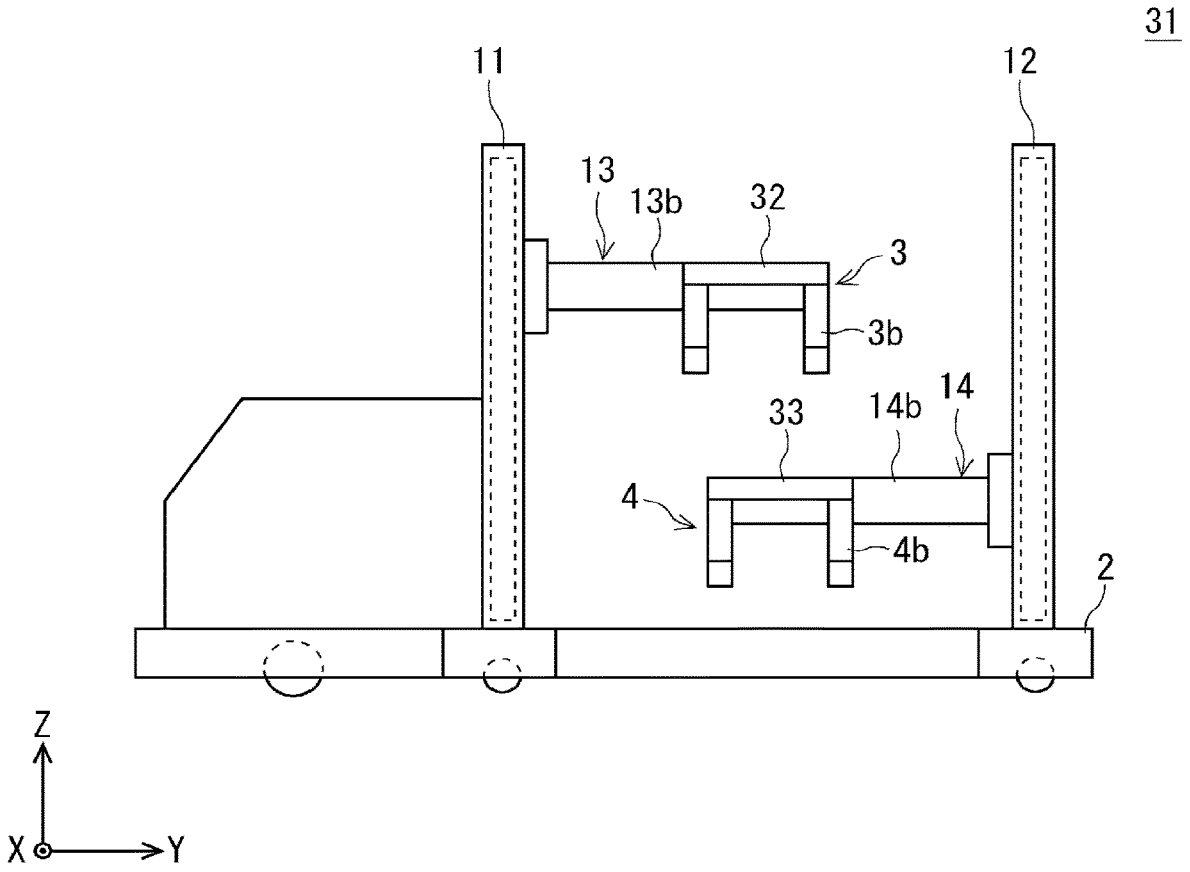
FIG. 7 is a side view schematically showing a fork lift device according to a third embodiment.

FIG. 7 is a side view schematically showing a fork lift device according to this embodiment. In FIG. 7, the configuration of the fork lift device is shown in a simplified manner. In the explanation given below, parts that are the same as those of the first embodiment are omitted and the corresponding members or the equivalent members are referred to by the same reference signs.

As shown in FIG. 7, a fork lift device 31 according to this embodiment has substantially the same configuration as that of the fork lift device 1 according to the first embodiment except that the fork lift device 31 includes a first interval changing mechanism 32 that changes an interval between the claw parts 3*b* of the first fork 3 in the Y-axis direction and a second interval changing mechanism 33 that changes an interval between the claw parts 4*b* of the second fork 4 in the Y-axis direction.

The first interval changing mechanism 32 includes, for example, a hydraulic cylinder in place of the base part 3*a* of the first fork 3, and is fixed to the arm part 13*b* of the first moving mechanism 13. Further, one of the claw parts 3*b* is fixed to the cylinder of the first interval changing mechanism 32 and the other claw part 3*b* is fixed to the rod of the first interval changing mechanism 32. By this configuration, the interval between the first claw parts 3*b* in the Y-axis direction is changed in accordance with the expansion/contraction of the first interval changing mechanism 32.

The second interval changing mechanism 33, for example, also includes a hydraulic cylinder disposed in place of the base part 4*a* of the second fork 4, and is fixed to the arm part 14*b* of the second moving mechanism 14. Then, one of the claw parts 4*b* is fixed to the cylinder of the second interval changing mechanism 33 and the other claw part 4*b* is fixed to the rod of the second interval changing mechanism 33. By this configuration, the interval between the second claw parts 4*b* in the Y-axis direction is altered owing to the expansion/contraction of the second interval changing mechanism 33.

By making the intervals between the claw parts 3*b* and between the claw parts 4*b* alterable in the Y-axis direction, for example, even when there are variations in the size of the pallets for the conveyance objects 7, it is possible to convey the conveyance objects 7 satisfactorily, and the versatility of the fork lift device can be enhanced.

However, the first interval changing mechanism 32 and the second interval changing mechanism 33 may be configured in any way as long as they can alter the interval in the Y-axis direction between the claw parts 3*b* or the claw parts 4*b*. For example, a linear actuator may be employed and the driving method thereof is not limited.

Further, in this embodiment, the interval changing mechanism is configured such that both the interval between the claw parts 3*b* and the interval between the claw parts 4*b* in the Y-axis direction are alterable. However, it may be configured such that the interval between the claw parts 3*b* or between the claw parts 4*b* in the Y-axis direction is alterable.

Fourth Embodiment

Figure 8:
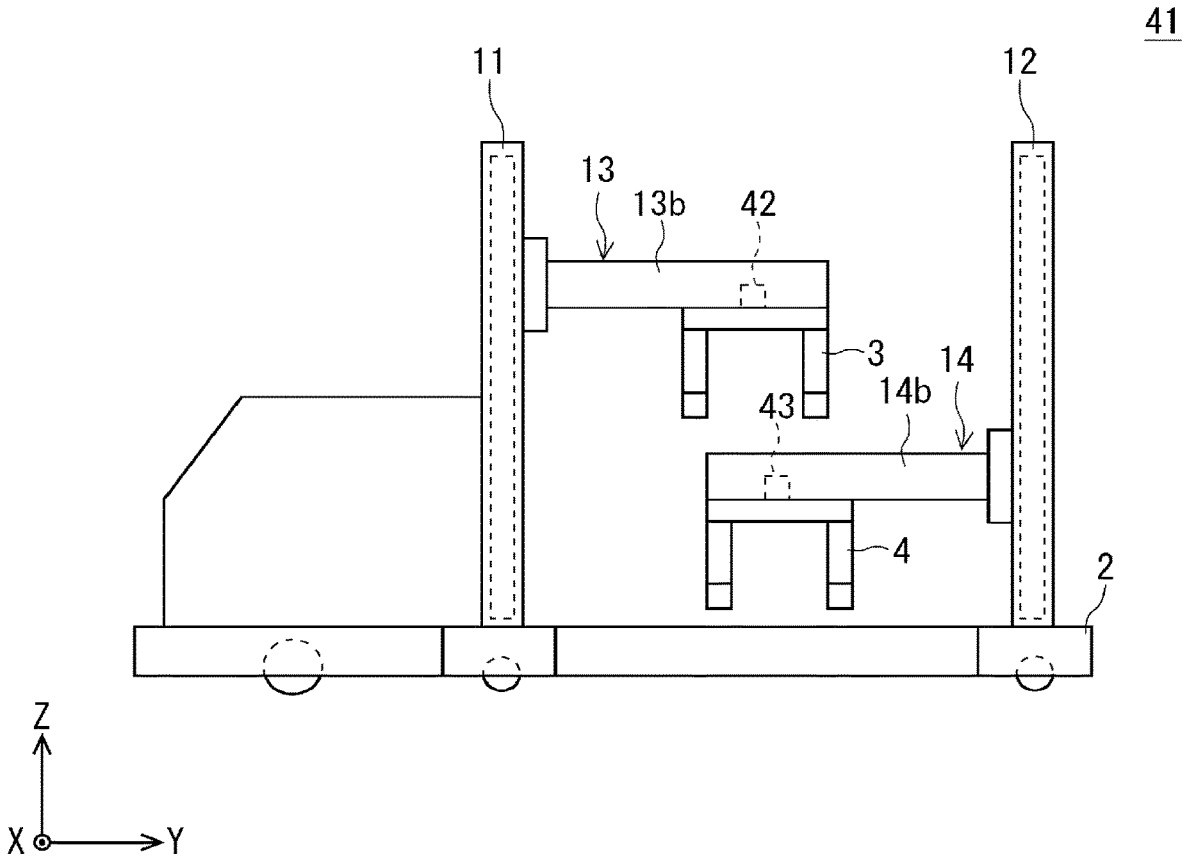
FIG. 8 is a side view schematically showing a fork lift device according to a fourth embodiment.

FIG. 8 is a side view schematically showing a fork lift device according to this embodiment. In FIG. 8, the configuration of the fork lift device is shown in a simplified manner. In the explanation given below, parts that are the same as those of the first embodiment are omitted and the corresponding members or the equivalent members are referred to by the same reference signs.

As shown in FIG. 8, a fork lift device 41 according to this embodiment has substantially the same configuration as that of the fork lift device 1 according to the first embodiment except that a first rotating mechanism 42 that rotates the first fork 3 and a second rotating mechanism 43 that rotates the second fork 4 are included.

The first rotating mechanism 42 includes, for example, a rotary shaft that extends in the Z-axis direction and connects the arm part 13*b* of the first moving mechanism 13 and the first fork 3 with each other, and a motor that rotates the rotary shaft, details of which are omitted in the figure. The first fork 3 rotates about the rotary shaft by driving the motor.

The second rotating mechanism 43 also includes, for example, a rotary shaft that extends in the Z-axis direction and connects the arm part 14*b* of the second moving mechanism 14 and the second fork 4 with each other, and a motor that rotates the rotary shaft, details of which are omitted in the figure. The second fork 4 rotates about the rotary shaft by driving the motor.

As described above, by making the first fork 3 and the second fork 4 rotatable, the conveyance object 7*a* can be pulled out in a satisfactory manner even when, for example, the conveyance object 7*a* to be pulled out is disposed in a rotated state relative to a conveyance object 7 in another tier.

However, the first rotating mechanism 42 and the second rotating mechanism 43 may be configured in any way as long as they can rotate the first fork 3 or the second fork 4, and the driving method thereof is not limited. Further, in this embodiment, both of the first fork 3 and the second fork 4 are structured to be rotatable. However, they may be structured such that either one of the first fork 3 or the second fork 4 is rotatable.

Fifth Embodiment

Figure 9:
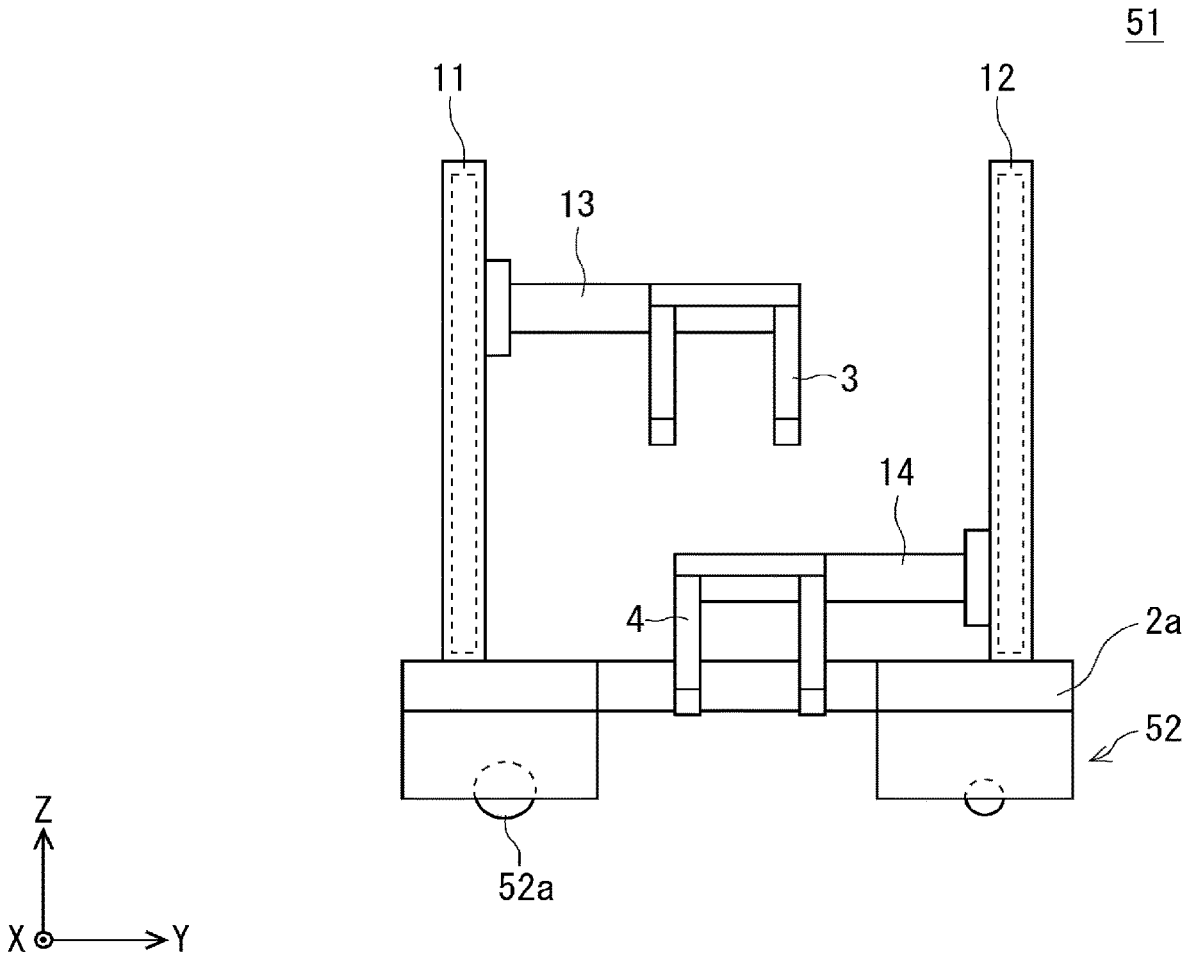
FIG. 9 is a side view schematically showing a fork lift device according to a fifth embodiment.

FIG. 9 is a side view schematically showing a fork lift device according to this embodiment. In FIG. 9, the configuration of the fork lift device is shown in a simplified manner. In the explanation given below, parts that are the same as those of the first embodiment are omitted and the corresponding members or the equivalent members are referred to by the same reference signs.

A fork lift device 51 according to this embodiment has substantially the same configuration as that of the fork lift device 1 according to the first embodiment except that a driving part 52 is disposed on the Z-axis negative side with respect to the frame part 2*a*. The driving part 52 includes, for example, a wheel 52*a* provided to a surface of the frame part 2*a* on the Z-axis negative side, and is configured to let the fork lift device 51 travel by rotating the wheel 52*a* using the motor.

As described above, by disposing the driving part 52 on the Z-axis negative side with respect to the frame part 2*a*, the length of the fork lift device 51 in the Y-axis direction can be shortened and the size of the fork lift device 51 can be reduced.

Sixth Embodiment

Figure 10:
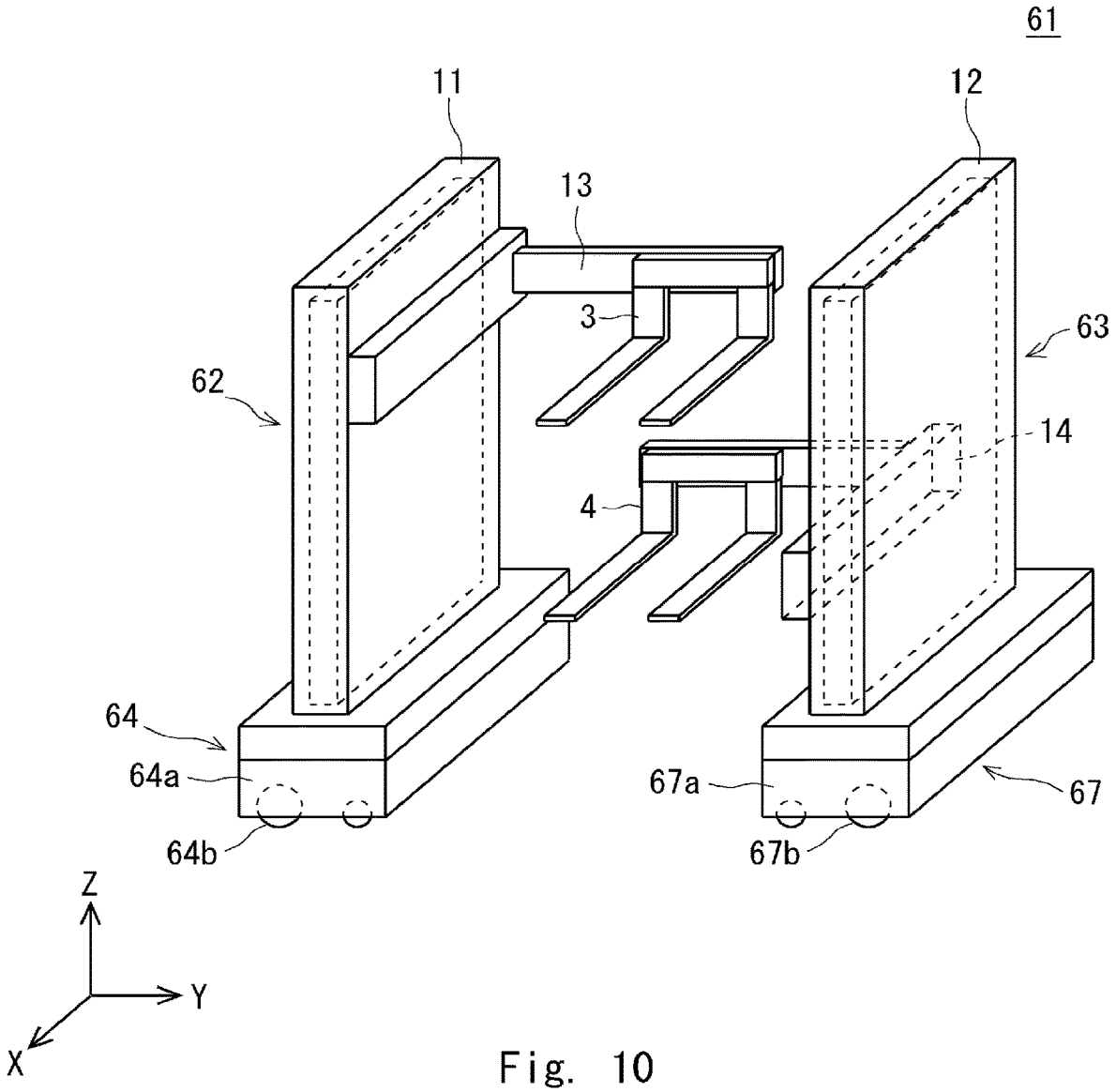
FIG. 10 is a perspective view schematically showing a fork lift device according to a sixth embodiment.
Figure 11:
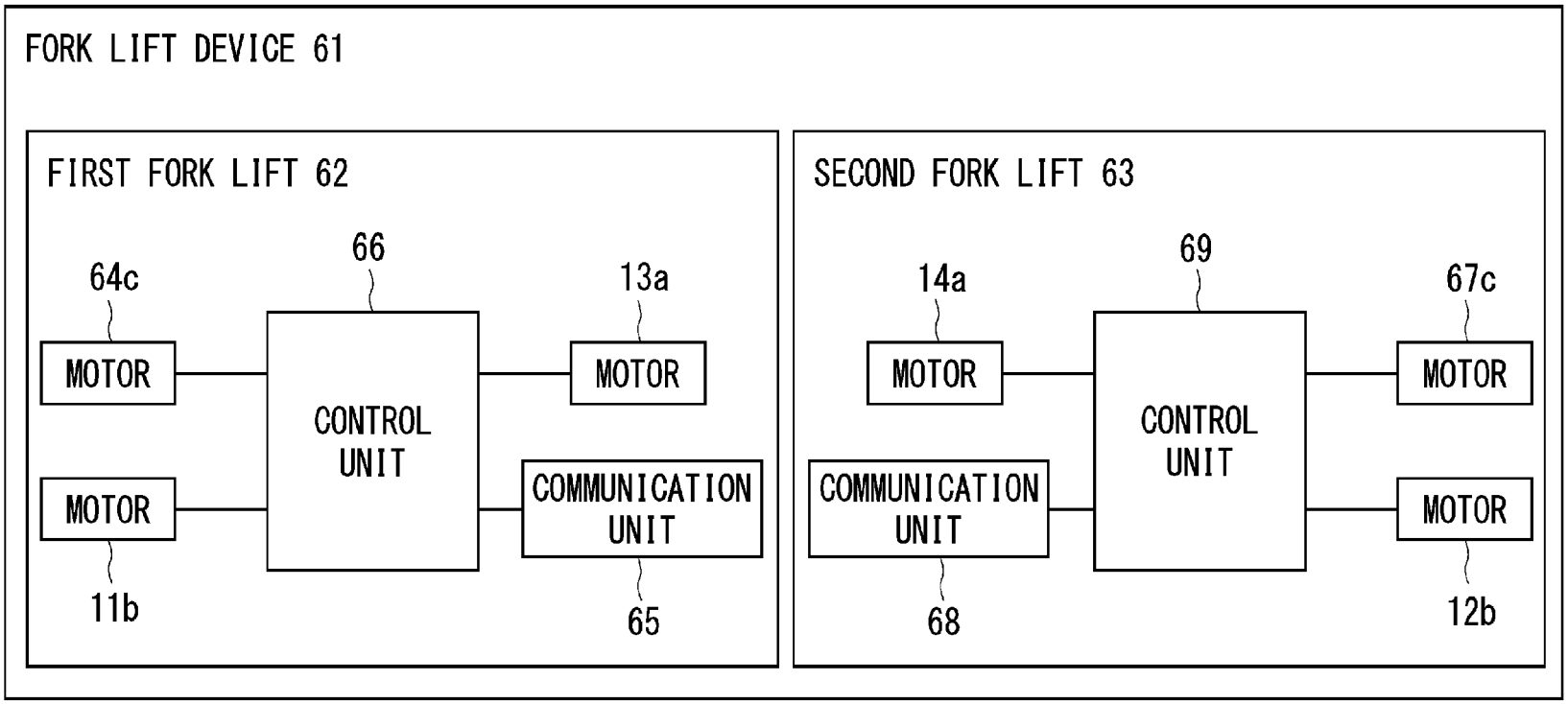
FIG. 11 is a block diagram showing a control system of the fork lift device according to the sixth embodiment.

FIG. 10 is a perspective view schematically showing a fork lift device according to this embodiment. FIG. 11 is a block diagram showing a control system of the fork lift device according to this embodiment. In FIG. 10, the configuration of the fork lift device is shown in a simplified manner. In the explanation given below, parts that are the same as those of the first embodiment are omitted and the corresponding members or the equivalent members are referred to by the same reference signs.

The fork lift device 61 according to this embodiment includes, as shown in FIG. 10, a first fork lift 62 and a second fork lift 63, and is configured to synchronously control the first fork lift 62 and the second fork lift 63 so as to pull out the desired conveyance object 7*a*.

To be more specific, the first fork lift 62 includes, as shown in FIGS. 10 and 11, a carriage (a first carriage) 64, the mast (the first mast) 11, the moving mechanism (the first moving mechanism) 13, the fork (the first fork) 3, a communication unit 65, and a control unit 66, and travels by the driving power transmitted from the driving part 64*a* of the carriage 64. At this time, the control unit 66 controls the motor 64*c* that rotates the wheel 64*b* of the driving part 64*a*, the motor 11*b* of the ascending/descending mechanism 11*a* of the mast 11, and the motor 13*a* of the moving mechanism 13.

The second fork lift 63 includes, as shown in FIGS. 10 and 11, a carriage (a second carriage) 67, the mast (the second mast) 12, the moving mechanism (the second moving mechanism) 14, the fork (the second fork) 4, a communication unit 68, and a control unit 69, and travels by the driving power transmitted from the driving part 67*a* of the carriage 67. At this time, the control unit 69 controls the motor 67*c* that rotates the wheel 67*b* of the driving part 67*a*, the motor 12*b* of the ascending/descending mechanism 12*a* of the mast 12, and the motor 14*a* of the moving mechanism 14.

The communication unit 65 of the first fork lift 62 and the communication unit 68 of the second fork lift 63 described above can communicate with each other by cable or wireless communication, and, for instance, the positional information of the fork lift and the positional information of the fork etc. are transmitted/received. Accordingly, one of the fork lifts can acquire the positional information of the other fork lift and the positional information of the fork thereof.

The control unit 66 of the first fork lift 62 and the control unit 69 of the second fork lift 63 control their own fork lifts so as to achieve the task of pulling out the desired conveyance object 7*a* by synchronously controlling the first fork lift 62 and the second fork lift 63 based on the positional information of their own fork lifts, the positional information of the forks of their own fork lifts, the positional information of the other fork lifts, and the positional information of the forks of the other fork lifts. For example, in order to achieve the task of pulling out the conveyance object 7*a* shown in FIGS. 5A to 5G, the first fork lift 62 and the second fork lift 63 are synchronously controlled.

As described above, by constructing the fork lift device 61 by using the first fork lift 62 and the second fork lift 63 that are separate from each other, the first fork lift 62 and the second fork lift 63 can be moved independently of each other apart from the case where the conveyance object 7 in the multi-tier state is pulled out from the lower tier.

Note that in this embodiment, the first fork lift 62 and the second fork lift 63 each includes a control unit, however, the first fork lift 62 and the second fork lift 63 may be controlled, for instance, by a control unit provided to a server.

The present disclosure is not limited to the embodiments mentioned above, and can be modified as appropriate without departing from the gist of the present disclosure.

For example, the fork lift device described above includes the first fork 3 and the second fork 4, however it may be of any configuration as long as it includes a plurality of forks.

For example, it is also possible to implement the fork lift device by combining the configuration of the fork lift device described in each embodiment.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A fork lift device comprising:

a first fork and a second fork moveable in a lateral direction and a vertical direction with respect to a traveling direction; and an interchanging mechanism configured to interchange vertical positions of the first fork and the second fork, wherein the interchanging mechanism comprises:

a first mast;

a second mast disposed at an interval from the first mast in the traveling direction;

a first moving mechanism provided on the second mast side of the first mast in a moveable manner in the vertical direction and configured to move the first fork in the lateral direction, and a second moving mechanism provided on the first mast side of the second mast in a moveable manner in the vertical direction and configured to move the second fork in the lateral direction, wherein positions of the first fork and the second fork in the vertical direction are interchanged by moving the first fork or the second fork in the lateral direction.

2. The fork lift device according to claim 1, wherein a length of one of the first moving mechanism and the second moving mechanism in the lateral direction is shorter than a length of the other moving mechanism in the lateral direction.

3. The fork lift device according to claim 1, wherein the interchanging mechanism comprises a third moving mechanism configured to move one of the first fork and the second fork in the traveling direction and a direction opposite to the traveling direction.

4. A fork lift device according to claim 1, wherein the interchanging mechanism comprises an interval changing mechanism configured to change an interval between claw parts of the first fork or the second fork.

5. The fork lift device according to claim 1, wherein the interchanging mechanism comprises a rotating mechanism configured to rotate the first fork or the second fork about a rotary shaft extending in the vertical direction.

6. The fork lift device according to claim 1, further comprising:

a first fork lift in which the first mast is supported by a first carriage; and a second fork lift in which the second mast is supported by a second carriage, wherein the first and second fork lifts are synchronously controlled to make them perform identical tasks.

* * * * *